US006257694B1

(12) United States Patent
Tokumaru et al.

(10) Patent No.: US 6,257,694 B1
(45) Date of Patent: Jul. 10, 2001

(54) INK JET PRINTER

(75) Inventors: Susumu Tokumaru; Yoshitaka Iwashita; Hiroshi Fukumoto; Hirohumi Matsuo, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/229,683

(22) Filed: Jan. 13, 1999

(30) Foreign Application Priority Data

May 25, 1998 (JP) ..... 10-143258

(51) Int. Cl.[7] ..... B41J 2/19
(52) U.S. Cl. ..... 347/19; 347/92
(58) Field of Search ..... 347/14, 19, 68, 347/92, 23

(56) References Cited

U.S. PATENT DOCUMENTS 4,308,547 12/1981 Lovelady et al. ..... 347/46
4,518,974 * 5/1985 Isayama ..... 347/92
4,973,981 * 11/1990 Bartky et al. ..... 347/19

FOREIGN PATENT DOCUMENTS 58-31763 2/1983 (JP) .
63-166545 7/1988 (JP) .

OTHER PUBLICATIONS

"Nozzleless Droplet Formation with Focused Acoustic Beams" by Elrod et al, J. Appl. Phys. 65(9), May 1, 1989.

* cited by examiner

*Primary Examiner*—John Barlow
*Assistant Examiner*—Craig A. Hallacher
(74) *Attorney, Agent, or Firm*—Sughrue, Mion, Zinn, Macpeak & Seas, PLLC

(57) ABSTRACT

An ink jet printer serves to solve a problem that ink is not normally discharged when bubbles are present in ink contained in a ink chamber of a print head. The ink jet printer performs normal discharge of ink by detecting bubbles contained in ink and carrying out an optimum head recovery operation, so that stable and high-quality printed matter can be obtained. According to a bubble detecting circuit and method employed in this ink jet printer, the impedance of the piezoelectric element of the head is first measured at given frequencies. Then, impedance versus frequency characteristics are obtained. Subsequently, it is determined, based on the impedance versus frequency characteristics, whether or not a bubble adheres to the piezoelectric element.

5 Claims, 6 Drawing Sheets

IMPEDANCE/FREQUENCY CHARACTERISTIC
(MEASUREMENT RESULT,T13)

INK JET PRINTER

BACKGROUND OF THE INVENTION

1. Field of the Invention

This invention generally relates to a liquid jetting device such as, for example, a humidifier for discharging water or vapor, a device for applying ink to an object and the like. More particularly, this invention relates to an ink jet printer for applying a jet of ink to a medium such as paper to be printed. Broadly, this invention is also concerned with a bubble detection circuit and method for use with such a liquid jetting device.

2. Description of the Related Art

FIG. 6 shows a conventional ink jet printer described in, for instance, Japanese Unexamined Patent Publication (Laid-Open) No. 6-336026.

In FIG. 6, reference numeral 1 designates a print head of the ink jet printer. This head 1 comprises a plurality of nozzles 2, a pressure chamber 17 formed in a housing 18, an ink path or passage 15, piezoelectric elements (or devices) 16*a* and 16*b* for changing the capacity or volume of the pressure chamber 17, and a heater 19 for heating the housing 18.

Further, an ink cartridge 6 provided with an ink container 4 is mounted on the housing 18. The ink container 4 communicates with the plurality of nozzles 2. Moreover, porous elements 9 and 13 for absorbing and holding ink are contained in the ink container 4. A heater 5 for heating ink is mounted on the outside surface of the ink container 4.

Next, an operation of this conventional ink jet printer will be described hereinbelow.

Usually, the ink passage 15 is filled with ink which is in a solid state. When a voltage is applied to the heater 5 mounted on the ink container 4 and to the heater 19 provided in the head 1, ink contained in the ink passage 15 and ink absorbed in the porous elements 9 and 13 are melted. Then, a voltage is applied to the piezoelectric elements 16*a* and 16*b*, which are in such a condition, to thereby vibrate these elements. Thus, the capacity of the pressure chamber 17 is changed, so that ink droplets are jetted out of the nozzles 2. As a result, the ink absorbed in the porous elements 9 and 13 are gradually supplied to the pressure chamber 17. Ink is jetted out of the head 1 by performing this operation, and is then caused to adhere to paper. Thus, printed matter is obtained.

The conventional ink jet printer has the following problem: when bubbles get into ink contained in the ink passage 15, ink cannot be normally discharged from the plurality of nozzles 2 so that printed matter obtained is thereby streaked, thus making it impossible to provide stable and high-quality printed matter.

Moreover, the conventional ink jet printer has no means for checking the presence or absence of a bubble before printing an image and so on. Thus, the conventional ink jet printer has a problem in that there is necessity for printing a test pattern to be used for determining whether or not ink is normally discharged.

Furthermore, in the case that normal printed matter is not obtained owing to the presence of bubbles when the test pattern is printed, the conventional ink jet printer should repeatedly perform the following process. Namely, in such a case, this printer first performs an ink supply recovery or resumption operation as a recovery measure. Then, this printer prints the test pattern again so as to check whether or not ink is normally discharged. Thus, this conventional ink jet printer has another problem in that it takes much time and costs to perform such a process.

SUMMARY OF THE INVENTION

The present invention is intended to solve the aforementioned problems of the conventional ink jet printer.

Accordingly, an object of the present invention is to provide an ink jet printer which measures the impedance of a piezoelectric element of a head at an arbitrary frequency before printing, and obtains the impedance versus frequency characteristics of the element and then determines, based on the impedance versus frequency characteristics, whether or not a bubble adheres to the piezoelectric element (namely, a bubble is formed in an ink chamber), and automatically performs an ink supply recovery operation or process when a bubble adheres to the piezoelectric element, thereby removing the bubble.

Another object of the present invention is to provide an ink jet printer capable of eliminating the necessity for printing a test pattern, thereby reducing the printing time and cost.

A further object of the present invention is to provide a bubble detecting circuit and method which can detect the fact that bubbles adhere to a head.

Bearing the above objects in mind, according to one aspect of the present invention, there is provided an ink jet printer in which ink is jetted out onto a medium to be printed under the action of a piezoelectric element of a head, the printer comprising: impedance measurement means for measuring impedance of the head at frequencies within a predetermined range thereof; impedance versus frequency characteristics obtaining means for obtaining impedance versus frequency characteristics of the head based on the measured impedance; and determination means for determining, based on the impedance versus frequency characteristics, whether or not a bubble adheres to the piezoelectric element.

In a preferred form of the invention, the ink jet printer further comprises head driving means for driving the head and switching means for switching between the head driving means and the impedance measurement means.

In another preferred form of the invention, the ink jet printer further comprises means for removing a bubble adhering to the piezoelectric element when the determination means determines that the bubble adheres thereto.

In a further preferred form of the invention, the ink jet printer further comprises erasable and writable storage means for storing information representing the impedance of the head upon initialization of the printer.

Besides, according to another aspect of the present invention, there may be provided a bubble detecting circuit for use in an apparatus of jetting out liquid by driving a piezoelectric element of a head. The bubble detecting circuit comprises impedance measurement means for measuring impedance of the head at frequencies within a predetermined range thereof, impedance versus frequency characteristics obtaining means for obtaining impedance versus frequency characteristics of the head according to the measured impedance, and determination means for determining, based on the impedance versus frequency characteristics, whether or not a bubble adheres to the piezoelectric element.

Moreover, according to a further aspect of the present invention, there may be provided a bubble detecting method comprising: a measurement step of measuring impedance of a head at frequencies within a predetermined range thereof;

and a determination step of obtaining impedance versus frequency characteristics of the head according to the measured impedance, and determining, based on the impedance versus frequency characteristics, whether or not a bubble adheres to the head.

Furthermore, the determination step comprises: a sub-step of obtaining the impedance versus frequency characteristics of the head according to the impedance thereof measured at the measurement step; a sub-step of performing a comparison between the impedance versus frequency characteristics obtained in this manner and predetermined impedance versus frequency characteristics; and a sub-step of determining according to the result of the comparison whether or not there is a bubble adhering to the head.

BRIEF DESCRIPTION OF THE DRAWINGS

The above and other objects, features and advantages of the present invention will become apparent from the following description of a preferred embodiment with reference to the accompanying drawings in which like reference characters designate like or corresponding parts throughout several views, and in which.

DESCRIPTION OF THE PREFERRED EMBODIMENT

Hereinafter, a preferred embodiment of the present invention will be described in detail by referring to the accompanying drawings.

Figure 1:
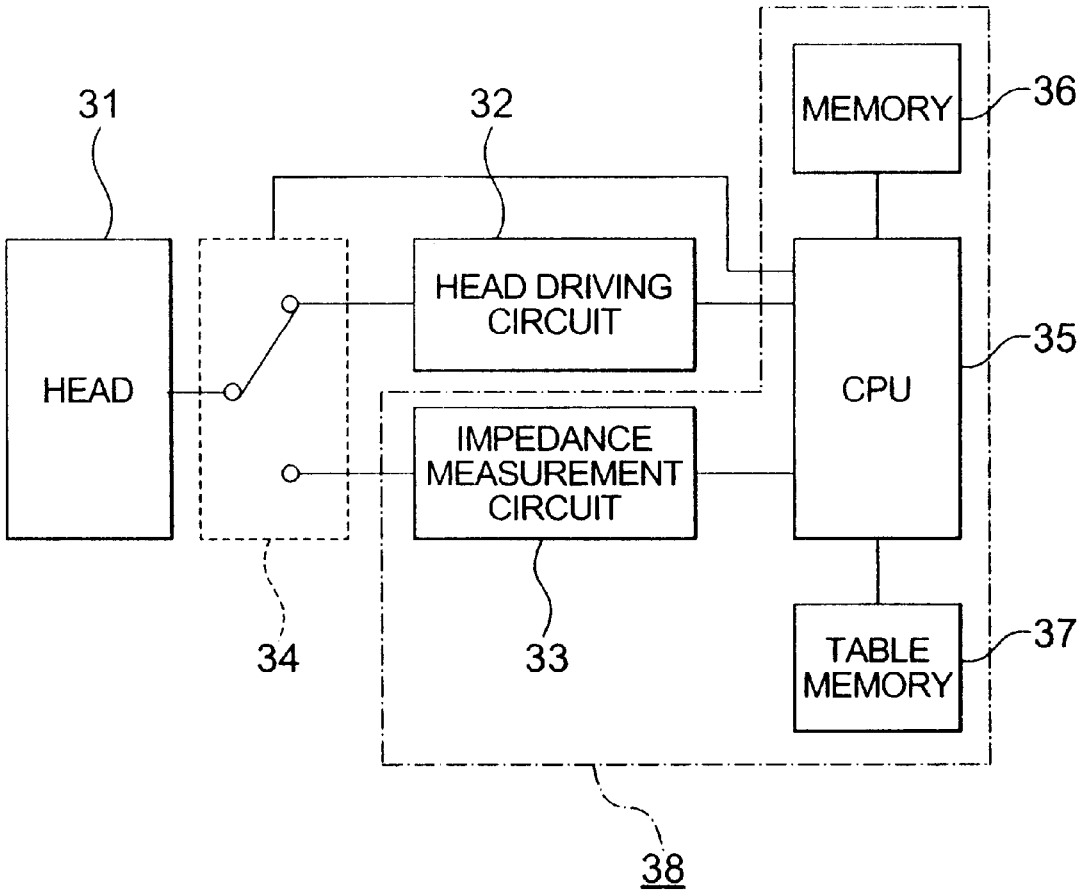
FIG. 1 is a block diagram schematically illustrating the configuration of an ink jet printer in accordance with the present invention.

FIG. 1 schematically shows the configuration of an ink jet printer constructed in accordance with principles of the present invention.

As shown in this figure, the ink jet printer has a print head 31 and a head driving circuit 32 for driving the head 31. The printer further has a bubble detecting circuit 38 and a switching circuit 34 for alternatively switching an electrical connection of the print head 31, between the head driving circuit 32 and the bubble detecting circuit 38.

The bubble detecting circuit 38 comprises an impedance measurement circuit 33, which is connected to and disconnected from the head 31 by the switching circuit 34, a central processing unit (CPU) 35 and a table memory 37.

The impedance measurement circuit 33 is operative to detect a voltage applied to and a current flowing through a head portion 120 (see FIG. 3) of the print head 31 at a predetermined frequency to thereby measure the impedance of the head portion 120. Preferably, the table memory is an erasable and writable memory such as, for example, an electrically erasable and programmable ROM (EEPROM) or a flash memory.

Incidentally, the impedance measurement circuit 33 constitutes an impedance measurement means for measuring the impedance of the head 31 at frequencies within a predetermined range thereof. The bubble detecting circuit 38 constitutes an impedance versus frequency characteristics obtaining means for obtaining the impedance versus frequency characteristics from the measured impedance, and a determination means for determining, based on the impedance versus frequency characteristics, whether or not bubbles adhere to the piezoelectric element.

Figure 2:
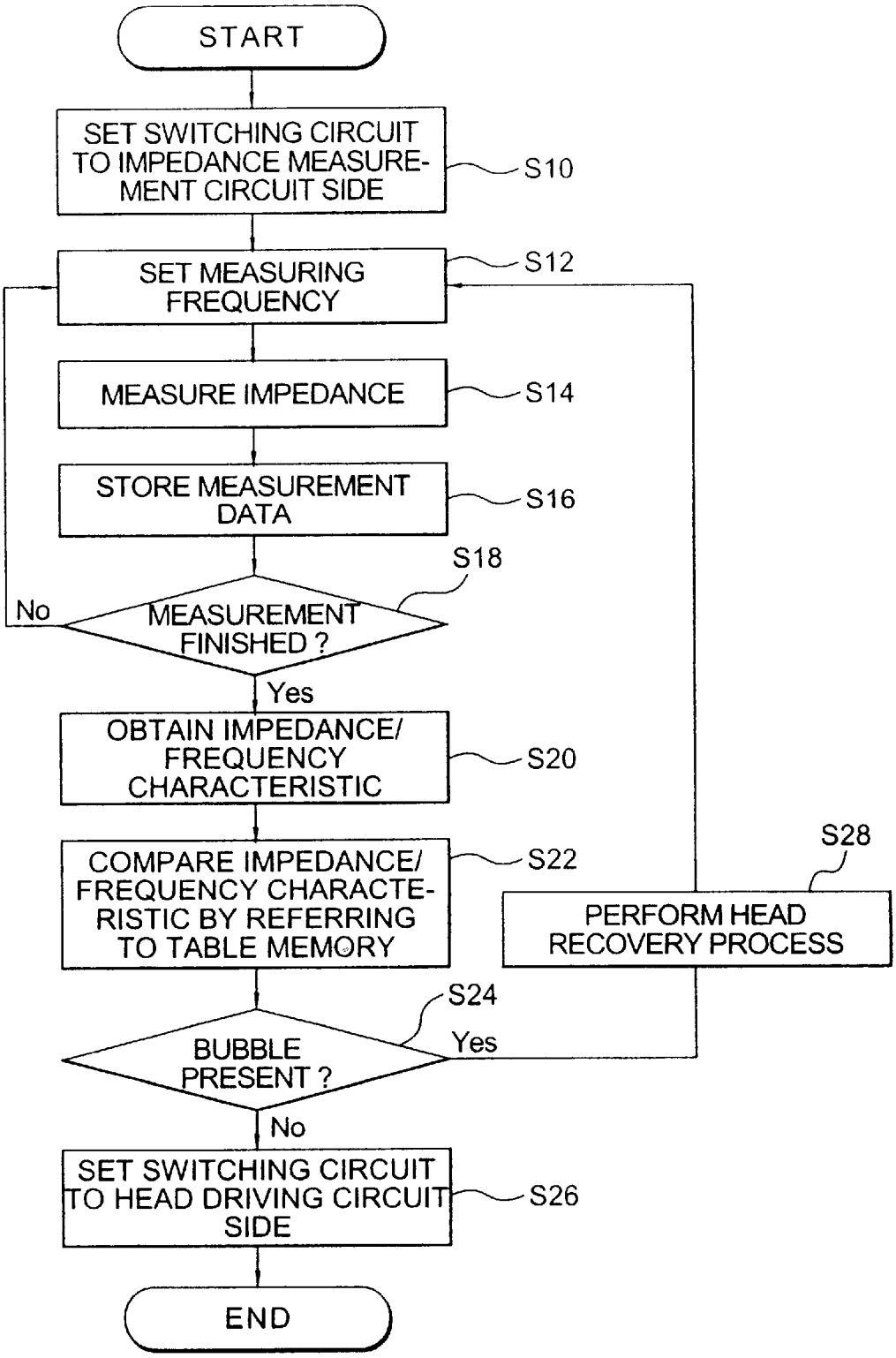
FIG. 2 is a flowchart illustrating an operation of a bubble detecting circuit of the ink jet printer of FIG. 1.

Next, the operation of the ink jet printer according to this embodiment will be described hereunder by referring to a flowchart of FIG. 2. Incidentally, FIG. 2 is the flowchart illustrating a bubble detecting method according to the present invention.

In the ink jet printer configured as described above, the CPU 35 sets the switching circuit 34 to a position corresponding to the impedance measurement circuit 33 before a printing process is performed (in step S10).

Thereafter, a measuring frequency is set in such a manner as to be within a predetermined range of frequencies (in step S12). Subsequently, the impedance of the head portion 120 at the frequency within the predetermined range thereof is measured (in step S14).

Then, measurement data representing the impedance measured in this manner are sequentially stored in the memory 36 (in step S16). Subsequently, it is decided whether or not the measurement of the impedance is finished (in step S18).

If it is decided in step S18 that the measurement of the impedance is finished, the impedance versus frequency characteristics are obtained (in step S20).

Then, the impedance versus frequency characteristics obtained from the measured impedance in such a manner are compared with those preliminarily obtained by experiment and stored in the table memory 37 (in step S22). Thus, it is determined whether or not a bubble is present (in step S24).

If it is determined in step S24 that a bubble is present, a head recovery process is performed (in step S28). Then, the control process returns to step S12 at which the measurement of the impedance is performed.

Conversely, if it is determined in step S24 that no bubble is present, the switching circuit 34 is set to a position corresponding to the head driving circuit 32 (in step S26). Then, the operation is terminated.

Namely, it is judged in step S24 from the impedance versus frequency characteristics whether or not a bubble is present. If the determination in step S24 is affirmative, the bubble is removed by automatically performing the head recovery process in step S28. During the head recovery process, ink is sucked from the nozzle 101 (see FIG. 3) of the head portion 120. Thus, the bubble is removed. Upon completion of the detection of bubbles, the switching circuit 34 is switched to the portion corresponding to the head driving circuit 32 (in step S26).

Next, the principle of the aforementioned bubble detection in step S24 will be described hereinbelow.

Figure 3:
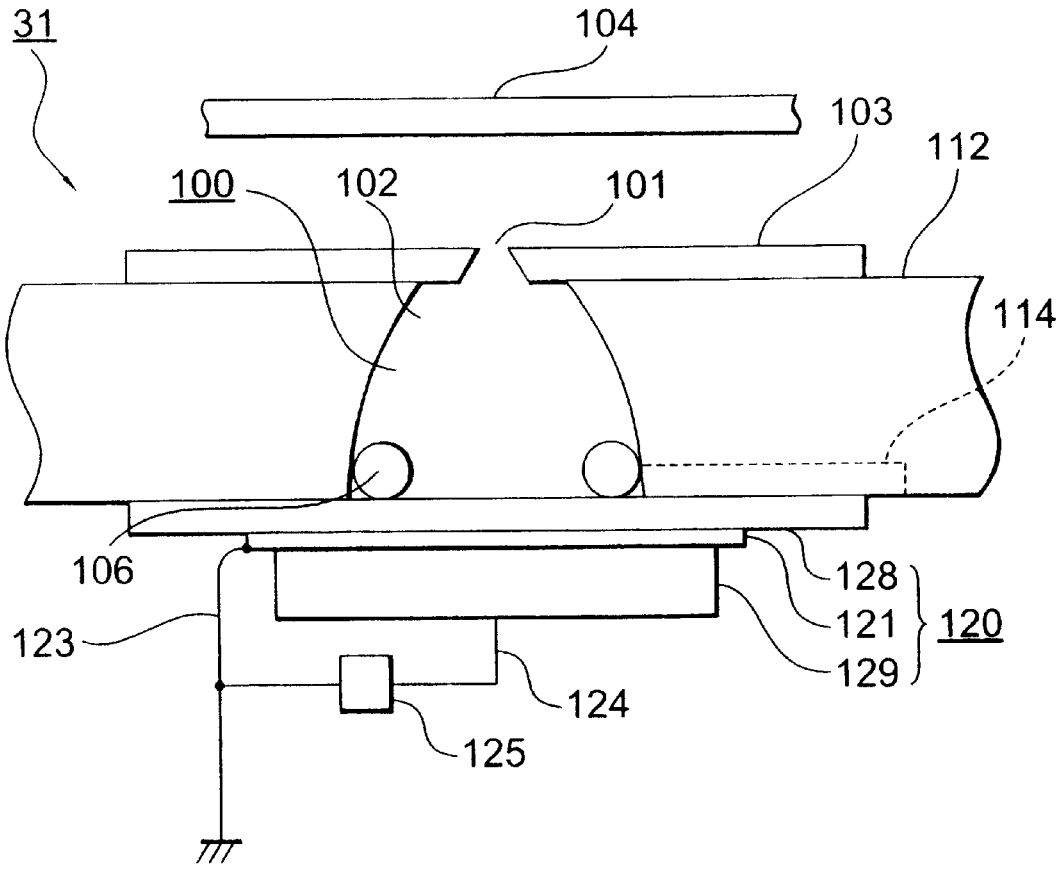
FIG. 3 is a diagram schematically illustrating a head of the ink jet printer according to the present invention.

First, the head portion 120 will be described in detail hereunder. FIG. 3 is a diagram schematically showing the configuration of an ink discharging portion of the ink jet printer of the present invention. In this figure, reference numeral 100 designates an ink chamber to be filled with ink 102. This ink chamber 100 is composed of a nozzle member 103 at an end surface portion of which a nozzle 101 having a diameter of tens of microns to several millimeters is formed, a reflecting plate 112 and a vibrating plate 128.

The head portion 120 has the vibrating plate 128 made of an insulating material such as polyimide. The portion 120 further has a piezoelectric element 129 adapted to vibrate at frequencies within a range thereof from hundreds kHz to hundreds MHz. Furthermore, the head portion 120 is formed by bonding the vibrating plate 128 and the piezoelectric element 129 together by use of an adhesive material 121.

A head control circuit 125 is connected to the adhesive material 121 and the piezoelectric element 129 through connecting lines 123 and 124, respectively, and is operative to apply a head driving signal to the piezoelectric element 129. Further, ink 102 is supplied from an ink supply passage or path 114 to the ink chamber 100 provided in the head portion 120.

When a head driving signal is supplied to the piezoelectric element 129 from the head control circuit 125, the piezoelectric element 129 vibrates and causes the vibrating plate 128 to vibrate. Thus, the ink 102 contained in the ink chamber 100 is thereby forced to vibrate. Moreover, the inside surface of the reflecting plate 112 provides energy to the ink 102 contained in the ink chamber 100, so that the ink 102 is caused to move upwardly, as viewed in FIG. 3. Thus, the ink 102 is discharged from the nozzle 101 and adheres to a printing paper 104. Consequently, an image is printed thereon. If a bubble 106 is formed in the ink chamber 100 at that time, as illustrated in FIG. 3, the ink 102 is not normally discharged from the nozzle 101 owing to the expansion and contraction of the bubble 106. This results in degradation in image printing accuracy.

Figure 4:
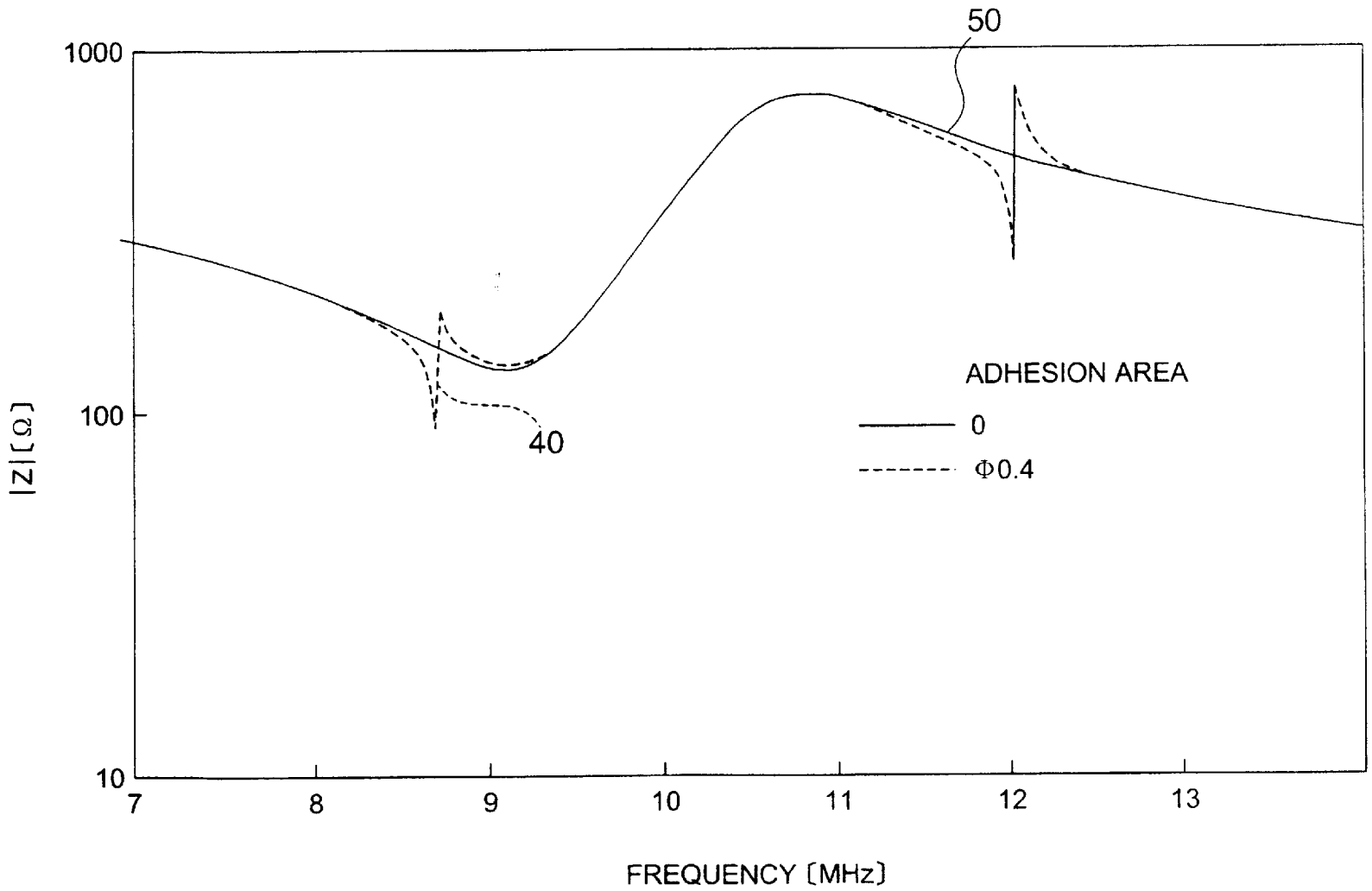
FIG. 4 is a graph showing calculated values of an example of the impedance versus frequency characteristics of the head.
Figure 5:
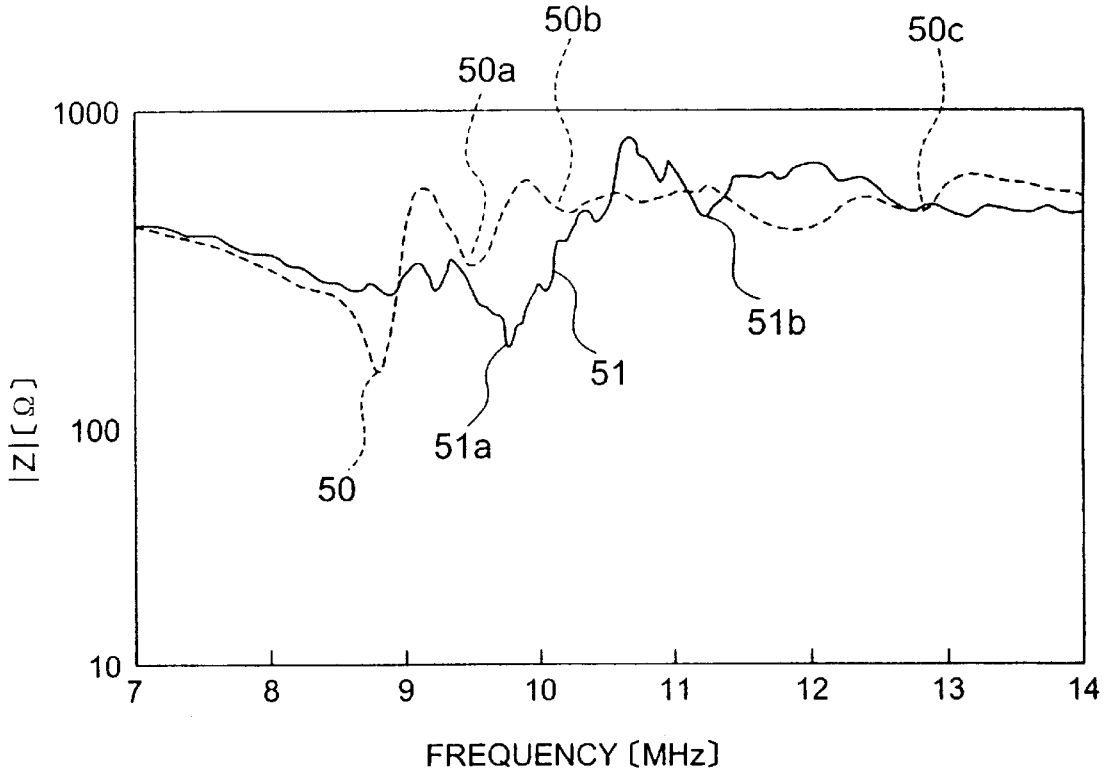
FIG. 5 is a graph showing experimental or empirical values of an example of the impedance versus frequency characteristics of the print head.
Figure 6:
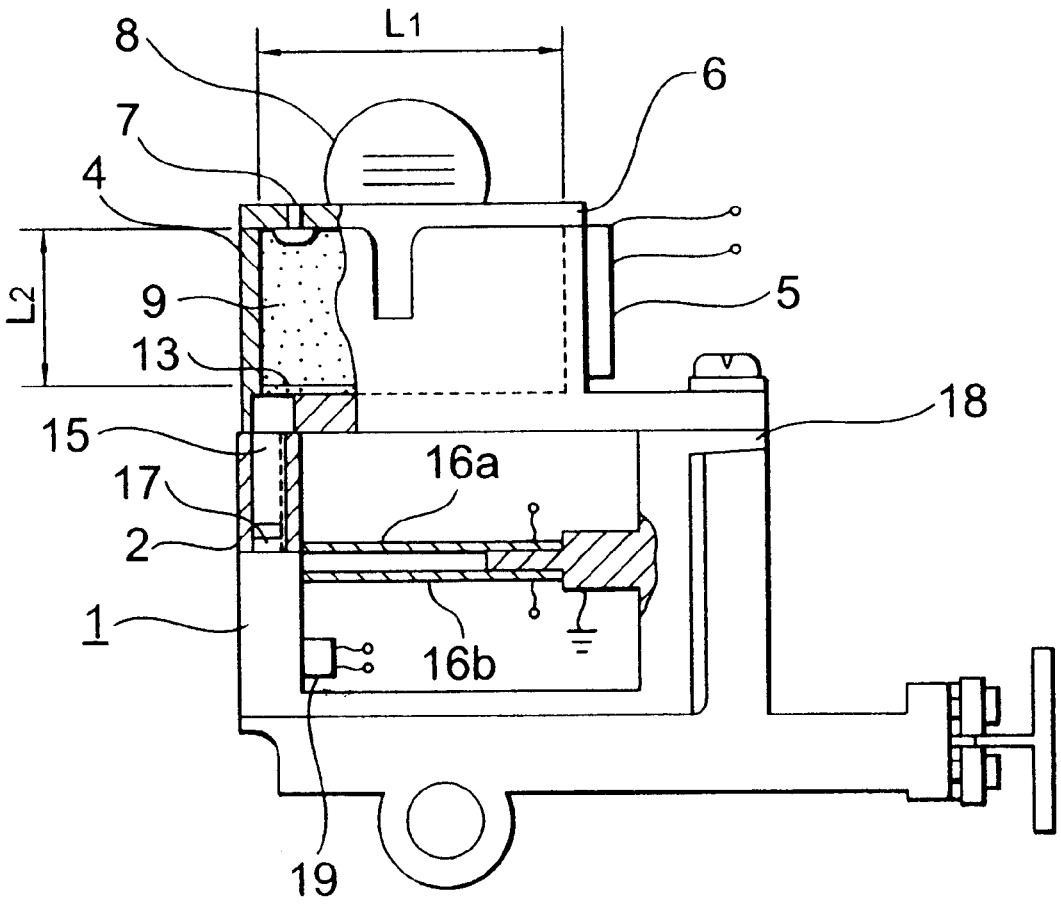
FIG. 6 is a diagram illustrating a conventional ink jet head.

Next, the impedance versus frequency characteristics of the head portion 120 will be described hereinbelow. FIG. 4 shows calculated values of the impedance versus frequency characteristics of the head portion 120 provided in the first embodiment of the present invention. FIG. 5 shows experimental values of the impedance versus frequency characteristics of the head portion 120 provided in the first embodiment of the present invention. Incidentally, in FIGS. 4 and 5, ordinates represent the natural logarithm of the impedance, while abscissas represent frequencies. Further, dashed lines represent the characteristics in the presence of a bubble in the ink contained in the ink chamber, while solid lines represent the characteristics in the absence of a bubble in the ink contained in the ink chamber.

As indicated by a dashed line in FIG. 4, the impedance has minimum values at specific frequencies in the impedance versus frequency characteristics 40 obtained as a result of calculation in the case that a bubble is present. In this case, the impedance has minimum values in the vicinities of frequencies of 8.5 MHz and 12 MHz, respectively. In the impedance versus frequency characteristics 41 obtained as a result of experiments in the absence of bubbles, the impedance does not have minimum values at these frequencies.

On the other hand, as indicated by a dashed line in FIG. 5, the impedance has minimum values at specific frequencies in the impedance versus frequency characteristics 50 obtained as a result of experiments in the presence of a bubble. In this case, the impedance has minimum values in the vicinities of frequencies of 8.5 MHz and 12 MHz, respectively. In the impedance versus frequency characteristics 41 obtained as a result of experiments in the absence of bubbles, the impedance does not have minimum values at these frequencies.

Incidentally, in the case of the characteristics represented by the experimental values shown in FIG. 5, the impedance has minimum values at points 50*a*, 50*b*, 50*c*, 51*a*and 51*b*, differently from the characteristics represented by the calculated values shown in FIG. 4. This is considered to be caused by waves reflected by the reflecting plate 112.

Results of the above experiments have revealed that the minimum points of the impedance vary with the shape and material of the piezoelectric element 129 and the material of the vibrating plate 128 to be disposed between the piezoelectric element 129 and the ink. It has been verified that the calculated values of the impedance versus frequency characteristics of the same head are almost in agreement with the experimental values thereof. Further, the results have proved that a variation in the diameter of the bubble 106 results in a change in the absolute values of the minimum values (or peak values) shown in FIGS. 4 and 5, but the frequencies respectively corresponding to the minimum values are inherent to the head. Therefore, such impedance versus frequency characteristics being characteristic of the head, namely, frequencies, at which the absolute value of the impedance has a minimum value, are preliminarily stored in the table memory 37. Moreover, before an image is printed, the impedance versus frequency characteristics are measured.

Furthermore, the measured frequencies respectively corresponding to the minimum values are compared with the frequency data preliminarily stored in the table memory 37 so as to detect the presence of a bubble. Further, in view of the influence of the reflected wave, it is preferable that experimental data be preliminarily checked and compared with calculated values before the calculated values are stored in the table memory 37.

Moreover, the present invention solves a problem of a change in the minimum points of the impedance, which is caused by a variation in the shape of the piezoelectric element 129, by using the table memory as means for determining whether or not a bubble is present. Thus, the present invention easily and flexibly copes with alteration of the piezoelectric element 129.

Meanwhile, although the present invention has been described herein as being applied to an ink jet printer, it is needless to say that the present invention is also applicable to any device for discharging liquid by using a piezoelectric element.

The device of the present invention as constructed above has the following excellent advantages.

Namely, bubbles adhering to the head can be detected before an image is printed. Further, the bubbles are completely removed by automatically performing a head recovery process so that ink can be normally discharged. Consequently, stable and high-quality printed matter can be obtained.

Moreover, the present invention eliminates the necessity for printing a test pattern. Furthermore, the present invention reduces the required printing time and cost.

Although the preferred embodiments of the present invention have been described above, it should be understood that the present invention is not limited thereto and that various changes and modifications can be made without departing from the spirit and scope of the invention as defined solely by the appended claims.

What is claimed is:

1. An ink jet printer in which ink is jetted out onto a medium to be printed under the action of a piezoelectric element of a head, said printer comprising:

erasable and writable storage means for storing information representative of preliminary impedance versus frequency characteristics of said head upon initialization of the printer;

impedance measurement means for measuring impedance of said head at frequencies within a predetermined range thereof;

impedance versus frequency characteristics obtaining means for obtaining measured impedance versus frequency characteristics of said head; and determination means for determining, based on the measured impedance versus frequency characteristics and the stored information, whether or not a bubble adheres to said piezoelectric element.

2. An ink jet printer in which ink is jetted out onto a medium to be printed under the action of a piezoelectric element of a head, said printer comprising:

impedance measurement means for measuring impedance of said head at frequencies within a predetermined range thereof;

impedance versus frequency characteristics obtaining means for obtaining impedance versus frequency characteristics of said head based on the measured impedance;

determination means for determining, based on the impedance versus frequency characteristics, whether or not a bubble adheres to said piezoelectric element;

head driving means for driving said head; and switching means for switching between said head driving means and said impedance measurement means.

3. The ink jet printer according to claim 1, further comprising means for removing a bubble adhering to said piezoelectric element when said determination means determines that the bubble adheres thereto.

4. A liquid jetting device in which a liquid is jetted under the action of a piezoelectric element, said device comprising:

erasable and writable storage for storing information representative of preliminary impedance versus frequency characteristics of said piezoelectric element upon initialization of the device;

impedance measuring circuit for measuring impedance of said piezoelectric element at frequencies within a predetermined range thereof;

impedance versus frequency characteristics obtainer for obtaining measured impedance versus frequency characteristics of said piezoelectric element; and determiner for determining, based on the measured impedance versus frequency characteristics and the stored information, whether or not a bubble adheres to said piezoelectric element.

5. The liquid jetting device according to claim 4, further comprising remover for removing a bubble adhering to said piezoelectric element when said determiner determines that the bubble adheres thereto.

* * * * *